US006544158B2

(12) United States Patent
Hill et al.

(10) Patent No.: US 6,544,158 B2
(45) Date of Patent: Apr. 8, 2003

(54) HIGH SPEED FEEDING APPARATUS FOR CLAMSHELL DIE CUTTER

(75) Inventors: Alan M. Hill, Tecumseh, KS (US); William R. Meeks, LeCompton, KS (US)

(73) Assignee: Lawrence Paper Company, Lawrence, KS (US)

( * ) Notice: Subject to any disclaimer, the term of this patent is extended or adjusted under 35 U.S.C. 154(b) by 0 days.

(21) Appl. No.: 09/950,996

(22) Filed: Sep. 12, 2001

(65) Prior Publication Data

US 2003/0047090 A1 Mar. 13, 2003

(51) Int. Cl.[7] ..... B31B 1/88

(52) U.S. Cl. ..... 493/53; 493/56; 493/61; 493/123

(58) Field of Search ..... 493/120, 123, 493/74, 61, 53, 56, 340, 194, 199

(56) References Cited

U.S. PATENT DOCUMENTS 2,110,212 A * 3/1938 Fitchett ..... 101/247
3,592,091 A * 7/1971 Ottavan ..... 101/227
3,998,119 A * 12/1976 Schroter ..... 83/328
4,494,455 A * 1/1985 Schoch ..... 101/3.1
4,767,393 A * 8/1988 Smith ..... 101/227
5,052,992 A * 10/1991 Hyder ..... 493/61
5,195,435 A * 3/1993 Morrone et al. ..... 101/151
5,704,196 A * 1/1998 Pazdernik et al. ..... 493/122

FOREIGN PATENT DOCUMENTS

WO WO 98/46400 * 10/1998 ..... B26D/5/04

* cited by examiner

*Primary Examiner*—Rinaldi I. Rada
*Assistant Examiner*—Paul Durand
(74) *Attorney, Agent, or Firm*—Hovey Williams LLP

(57) ABSTRACT

A processing station (10) for high speed printing, handling and die cutting of blanks or blanks (26) is provided which includes a clamshell-type die cutter (12), as well as a feeding device (14) including a transfer mechanism (16) and pickup member (18). The station (10) may also include a printing assembly (20) and a cut blank removal assembly (22). In operation, individual blanks (26) from a stack (28) are successively fed by the transfer mechanism (16) and are picked up by the member (18); the blanks are delivered to the die cutter (12) when the latter is open and after die cutting the removal assembly (22) is employed to lift the cut blank (26) from the cutter (12) and shift the blank (26) to a slide plate (116). A pusher bar (122) then operates to move the cut blank (26) to an outfeed conveyer (146). The station (10) is capable of handling relatively thick corrugated blanks (26) at high speed and without constant operator attendance.

10 Claims, 7 Drawing Sheets

HIGH SPEED FEEDING APPARATUS FOR CLAMSHELL DIE CUTTER

BACKGROUND OF THE INVENTION

1. Field of the Invention

The present invention is broadly concerned with the improved processing equipment designed to rapidly handle, imprint, die cut and transfer sheet-type blanks and especially relatively thick corrugated blanks. More particularly, the invention is concerned with such equipment, and corresponding methods, wherein blanks are successively fed along a generally horizontal path through a printing station and then through handling equipment; at this point a movable pickup member is employed for lifting and delivering the blanks to the open platens of a clamshell die cutter. After cutting, a removal assembly picks up the processed blanks and delivers them to an outfeed conveyer for downstream processing.

2. Description of the Prior Art

Clamshell die cutters have long been available and used in the paper converting industry. Generally speaking, clamshell die cutters include a relatively massive frame supporting a pair of platens. Normally, one platen is stationary whereas the other is moved through an arcuate path between a full open position allowing a blank to be placed on the platen, to a cutting position where the blank is die cut. One of the platens carries a cutting die so that, when the movable platen is closed, an accurate die cut is achieved.

In typical operations with clamshell die cutter, an operator stands near the device and manually removes a cut blank from the opened platen and then places a fresh uncut blank thereon. This is of course an extremely labor-intensive undertaking, given that the operator must constantly attend the die cutter and insure that each individual blank is placed in perfect alignment for proper cutting. Moreover, any carelessness on the part of the operator quickly leads to a relatively serious industrial accident, where the operator inadvertently leaves his hand or arm between the platens as they close.

It has been proposed in the past to provide automatic feeders for clamshell die cutters. One such design incorporates an elevator wherein a stack of blanks is successively elevated and delivered into the die cutter. However, such elevator units have only a limited blank capacity and thus must be reloaded on a frequent basis. For example, where corrugated blanks are processed, the elevator feeder can accommodate only about 150 blanks. This means that the feeder must be reloaded approximately every 7 minutes.

High throughput die cutting devices have also been used in the past which differ fundamentally from clamshell cutters. These units operate by moving a die-carrying platen in a reciprocal, up-and-down fashion. With these die cutters, blanks are successively fed between the opened platens, and are die cut as the upper platen moves downwardly; the cut blanks are then removed from the platen assembly for further processing. While die cutters of this variety are capable of high speed operation even when corrugated blanks are processed, they are extremely expensive as compared with clamshell die cutters.

There is accordingly a need in the art for improved blank processing equipment making use of a relatively inexpensive clamshell die cutter while nevertheless achieving the high operating speeds of reciprocal die cutters.

SUMMARY OF THE INVENTION

The present invention overcomes the problems outlined above and provides processing equipment in the form of a station including a clamshell die cutter and a feeding device operable to feed individual feedstock blanks into the clamshell cutter when the latter is open, with the feeding device comprising a transfer mechanism for individually shifting respective blanks from a stack thereof toward the die cutter, and a pickup member that moves cut blanks from the feeding device to the die cutter when the latter is open. Preferably, the overall station includes a printing assembly designed to print each successive blank, together with a cut blank removal assembly designed to pick up a cut blank from the die cutter for transfer and downstream processing.

Preferably, the transfer mechanism comprises a reciprocal pusher plate operable to engage and shift the bottom most blank from a stack thereof along with a transfer belt presenting a generally horizontal upper run orientated to receive the blank and deliver the same for pickup. The printing assembly is advantageously located between the pusher plate and the transfer belt. The preferred pickup is vacuum-operated and includes a shiftable arm operated in timed relationship with the pusher plate and transfer belt. The blank removal assembly likewise includes a vacuum pickup member, supported on arms so that it is moved from a pickup position adjacent the clamshell die when the latter is open, and a delivery position.

DETAILED DESCRIPTION OF THE PREFERRED EMBODIMENT

Figure 1:
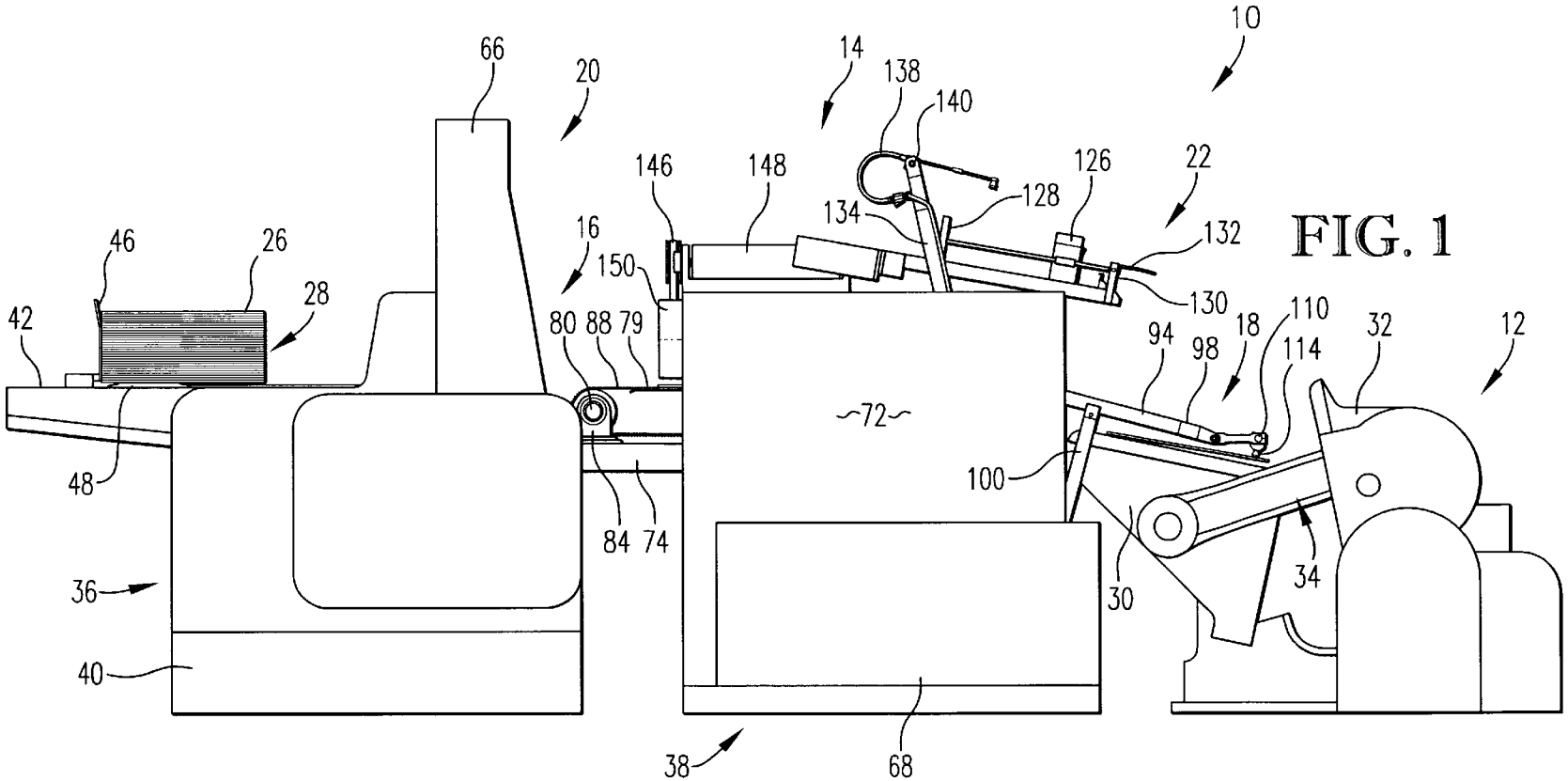
FIG. 1 is a side elevational view of a processing station in accordance with the invention, including a clamshell die cutter and a feeding device operable to feed individual sheet blanks into the die cutter, and to remove cut blanks therefrom, shown with the die cutter in its open position and with the feeding device depositing a blank onto the open platen of the die cutter.

Turning now to the drawings, a processing station 10 in accordance with the invention broadly includes a clamshell die cutter 12, a feeding,device 14 having a transfer mechanism 16 and a pickup member 18. In addition, the preferred station 10 also includes a printing assembly 20, a cut blank removal assembly 22 and a stripper table 24(see FIG. 2). The station 10 is designed to individually print, transfer and die cut a series of blanks 26 provided in a stack 28, and to thereafter remove the cut blanks for downstream processing. The station 10 is particularly suited for the high speed handling of relatively thick corrugated sheet blanks, although virtually any other type of feedstock may be handled as well.

Figure 4:
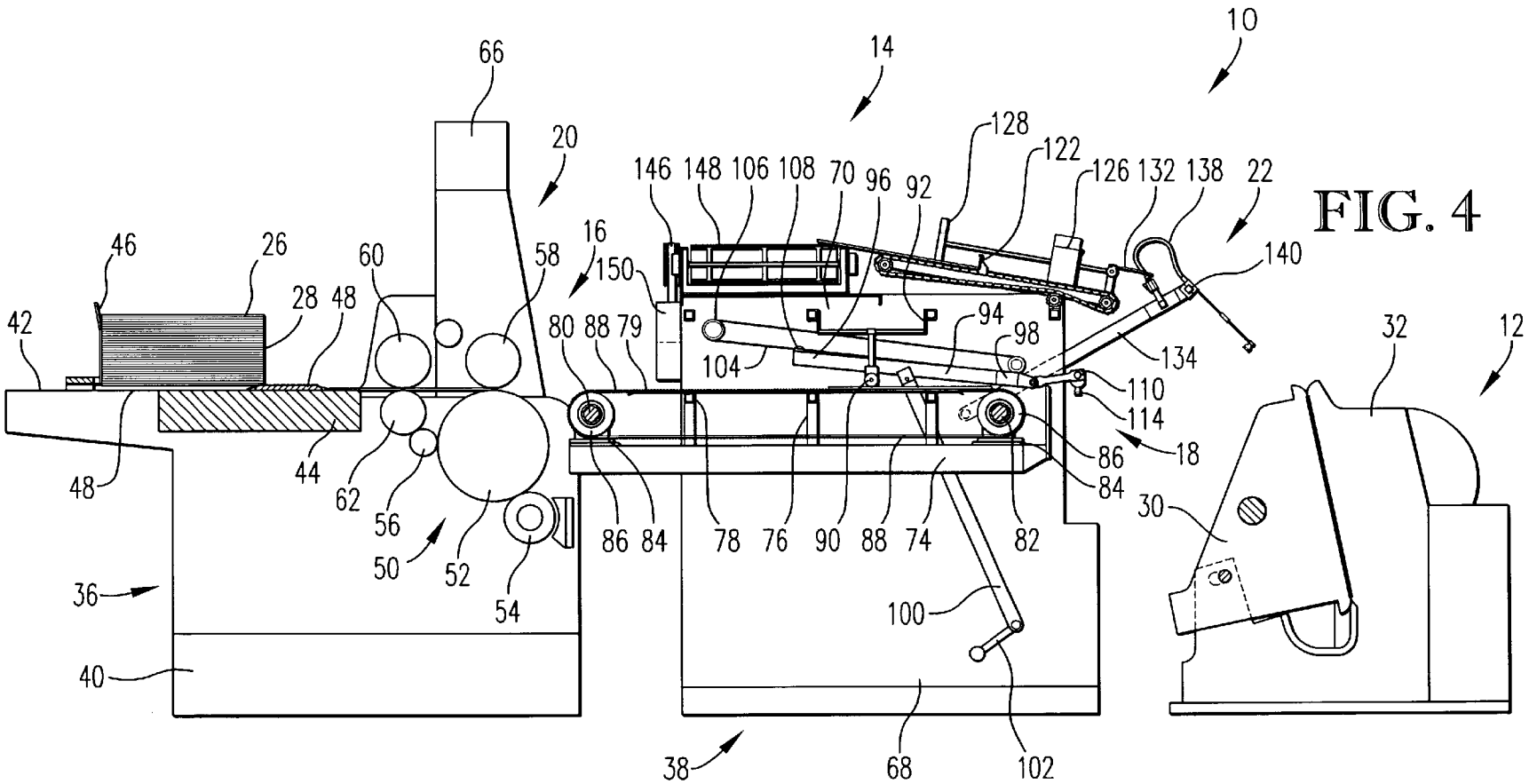
FIG. 4 is a sectional view similar to that of FIG. 3, but illustrating the clamshell die cutter in its closed, die cutting configuration.

In more detail, the clamshell die cutter 12 includes a pair of relatively shiftable platens 30, 32 together with powered operating means 34 for repetitively moving the platens together to effect a die cut, followed by separation of the platens. Thus, FIG. 1 illustrates the full-open position of the cutter 12, with the platen 30 separated from cooperating platen 32, whereas FIG. 4 shows the platens in their adjacent, cutting position; the remaining Figures depict the platens in intermediate positions. The platen assembly is provided with an appropriate die (not shown) which provides the desired cutting of the individual blanks 26.

Figure 2:
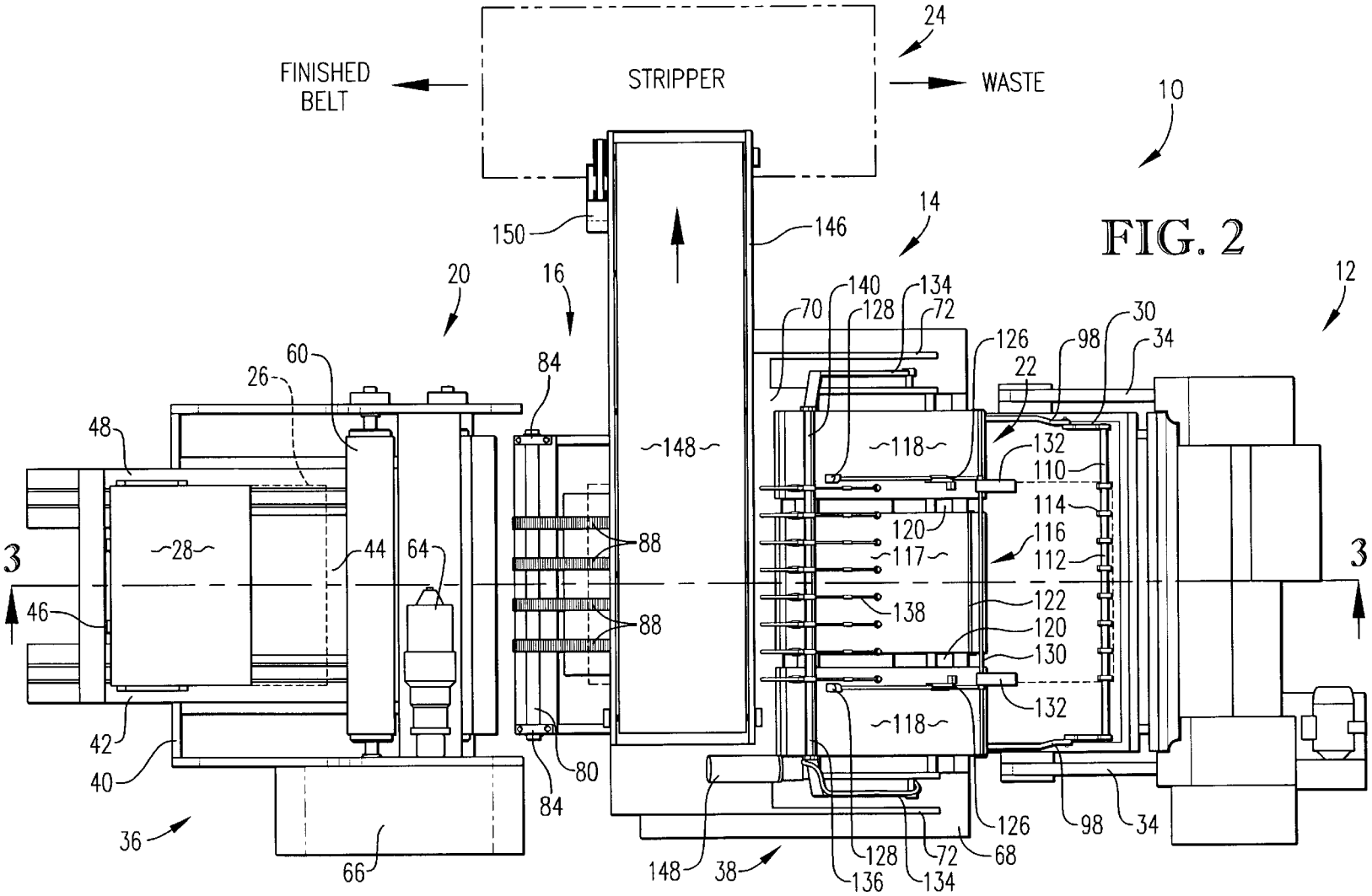
FIG. 2 is a plan view of the station depicted in FIG. 1.
Figure 3:
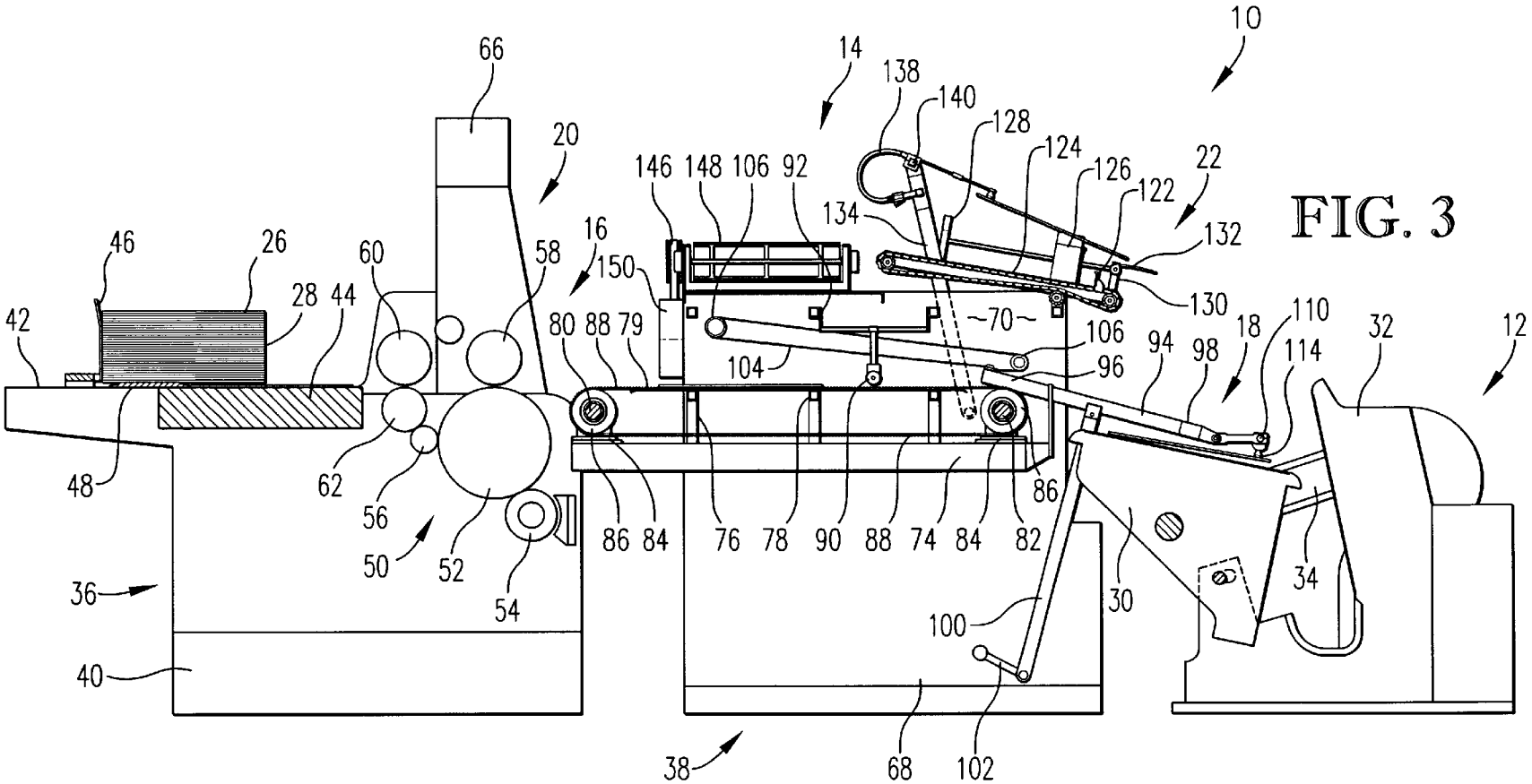
FIG. 3 is a vertical sectional view taken along line 3—3 of FIG. 2 and illustrating the construction of the processing station.

The transfer mechanism 16 is made up of a printing tower 36 and a specially designed blank handler 38, with the tower 36 and handler 38 oriented in an in-line manner as illustrated in FIG. 2. In particular, the tower 36 includes an upright frame 40 supporting a horizontal feed table 42 the latter having a vacuum, hold-down section 44, an upstanding stack retainer 46 and a powered, shiftable pusher plate 48 which is slidable along table 42 for successively delivering the bottom most blank 26 for processing. The printing assembly 20 is also supported on frame 40 and includes a conventional printing roll train 50 with a plate roller 52, inking roller 54, smoothing roller 56 and backing roller 58. In addition, it will be observed that the printing assembly 20 also has a pair of adjacent entrance nip rollers 60, 62 upstream of the plate and backing rollers 52, 58. The roll train 50 is powered by a conventional drive including motor 64 and a gear train (not shown) housed within upright housing 66.

The handler 38 has an upright frame 68 presenting inner and outer, spaced apart sidewalls 70, 72 (see FIGS. 7–8), with a lower table 74 between the inner walls. The table 74 is supported by struts 76 and crosspieces 78 welded or otherwise affixed to the inner sidewalls; the crosspieces 78 also support an upper slide plate 79. The table 74 supports a pair of endmost shafts 80, 82 via bearing mounts 84. The shafts 80, 82 are each equipped with four laterally spaced apart belt-supporting rollers 86, and each aligned pair of these rollers has a transfer belt 88 trained therearound. It will be seen that the upper runs of the belts 88 pass over and are supported by upper slide plate 79. A sheet hold-down roller 90 is positioned slightly above the belts 88 and is supported by a crossframe 92 extending between inner walls 70.

Figure 7:
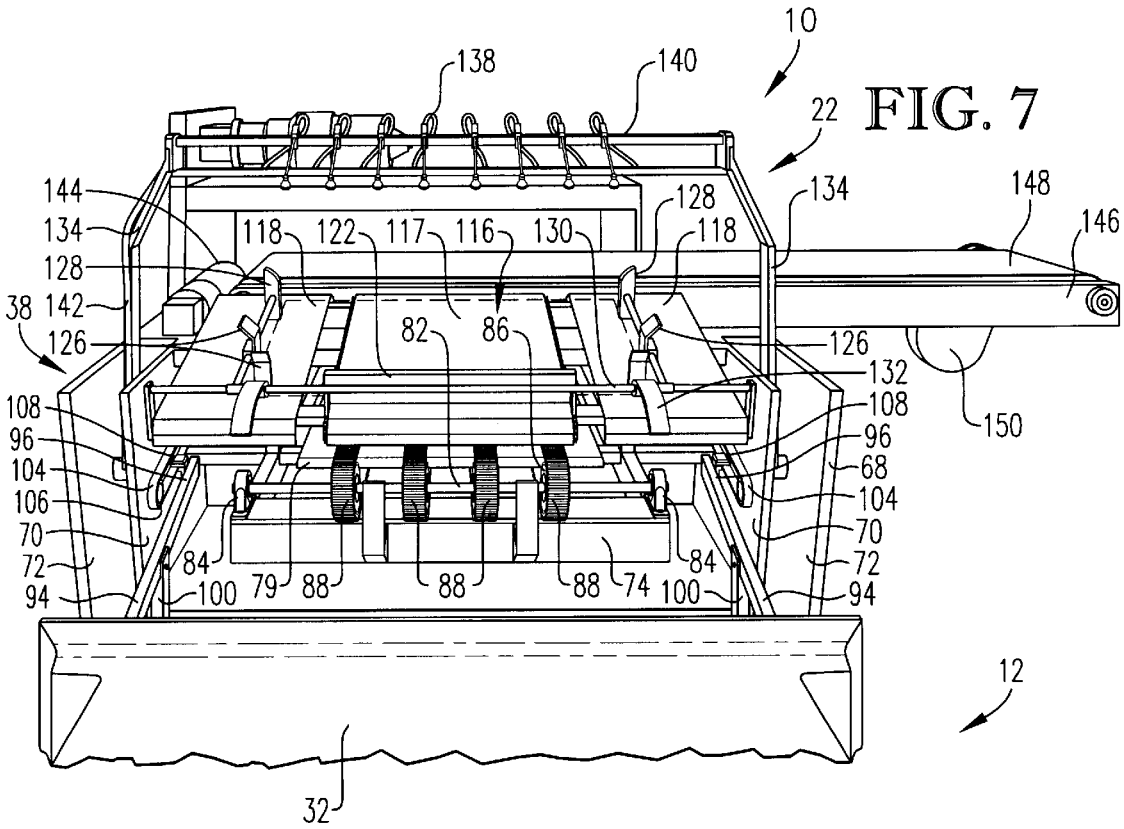
FIG. 7 is a fragmentary, front view of the processing station, showing a cut blank deposited on the slide plate of the blank removal assembly.
Figure 8:
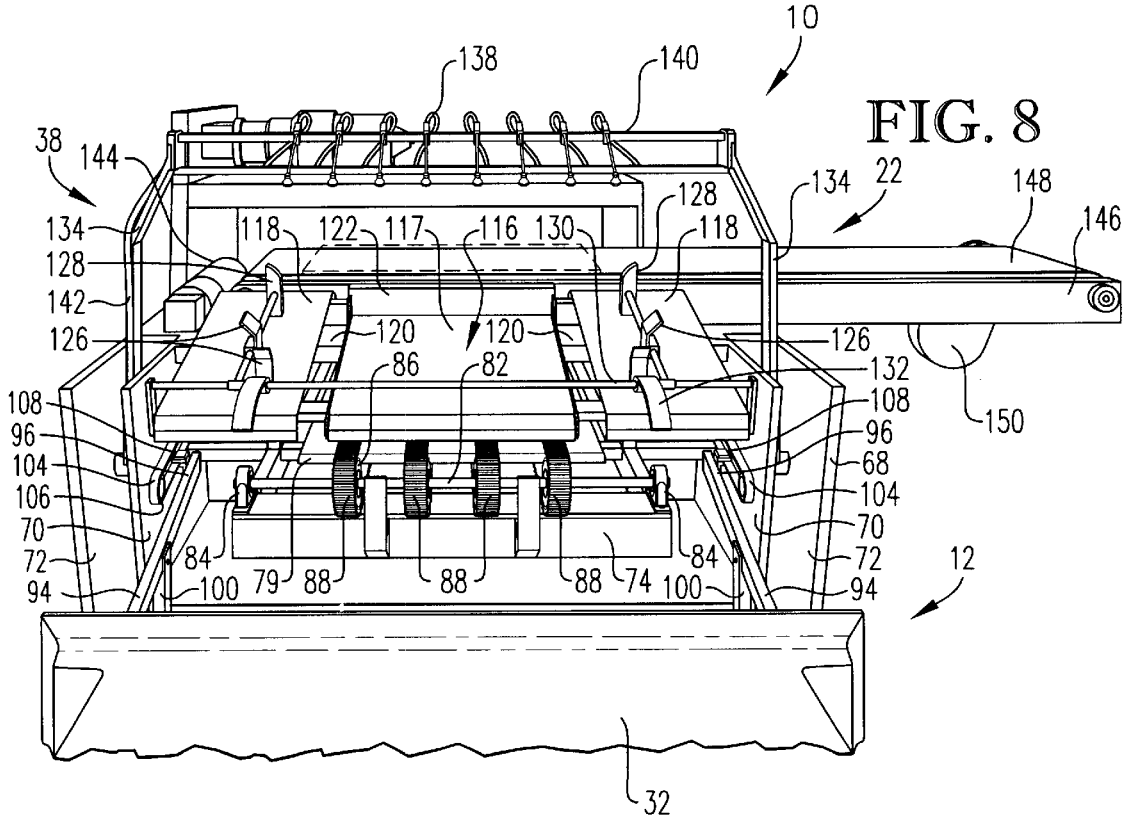
FIG. 8 is a fragmentary, front view similar to that of FIG. 7, and showing the cut blank delivered to an outfeed conveyer.

The handler is also equipped with a vacuum pickup member 18 which includes a pair of elongated spaced apart pickup arms 94 each having an inner connection end 96 and an outer pickup end 98. A support link 100 is pivotally coupled to each arm 94 intermediate the ends thereof, with the lower ends of the links 100 pivotally connected to the frame 68 through legs 102. The inner ends 96 of the arms 94 are connected to corresponding reciprocating belts 104 secured to each wall 70 and trained about pulleys 106. As best seen in FIGS. 7–8, the ends 96 are secured to the adjacent belts 104 through connection clips 108. A pickup head 110 extends between and is pivotally mounted to the outer ends 98 of the arms 94. The head 110 includes an elongated vacuum bar 112 having a series of spaced apart vacuum cups 114 along the length thereof. The bar 112 includes short pivotal links for connection to the arm ends 98 as shown. Also, a vacuum line (not shown) is provided in operative communication with bar 112 and cups 114.

The cut sheet removal assembly 22 is supported by frame 68 and includes a slide plate 116 including a central section 117 and laterally spaced marginal sections 118 separated by slots 120. A central pusher bar 122 rides atop section 117 and is movable by means of two chain drive assemblies 124 located beneath and along the side edges of section 117. For this purpose, the pusher bar has marginal connectors securing the bar to the respective assemblies 124. As best seen in FIGS. 7–8, the marginal sections 118 have upstanding alignment guides 126, 128, and the forward section of the slide plate 116 includes an upstanding bail 130 with arcuate guides 132.

The overall assembly 22 also has a pair of elongated cut blank pickup arms 134 which are each pivotally coupled to the frame 68 between the sidewalls 70,72. The arms 134 have a dogleg configuration and support a transversely extending vacuum head 136 with the latter having a plurality of spaced vacuum pickup fingers 138 mounted on pivotal crossbar 140. As illustrated, vacuum tubing 142 is provided which communicates with head 136 and fingers 138 during operation of the station 10. Timed movement of the pickup head 136 is effected through motor 144 operatively coupled with the arms 134.

An outfeed conveyer 146 is positioned adjacent the upper end of slide plate 116 and is oriented transverse to the in-line arrangement of tower 36, handler 38 and die cutter 12. The conveyer is itself entirely conventional including shiftable belt 148 powered through motor 150.

The output end of the conveyer 146 feeds product to the conventional product stripper 24, whereupon waste and finished blanks are directed from the stripper.

The various components of station 10 are operated in timed relationship in the manner described below. Preferably, the timing between sheet handler 38 and clamshell die cutter 12 is established through use of a common driveline (not shown). The remaining components, including those of tower 36, are timed through use of conventional sensors and microprocessor control. Of course, such timing expedients are well known to those skilled in the art.

Operation

Initially, a stack 28 of feedstock blanks 26 is placed on feed table 42 adjacent retainer 46. Also, the printing assembly 20 is readied for operation with an appropriate plate mounted on roller 52 and ink supplied to roller 54.

Figure 5:
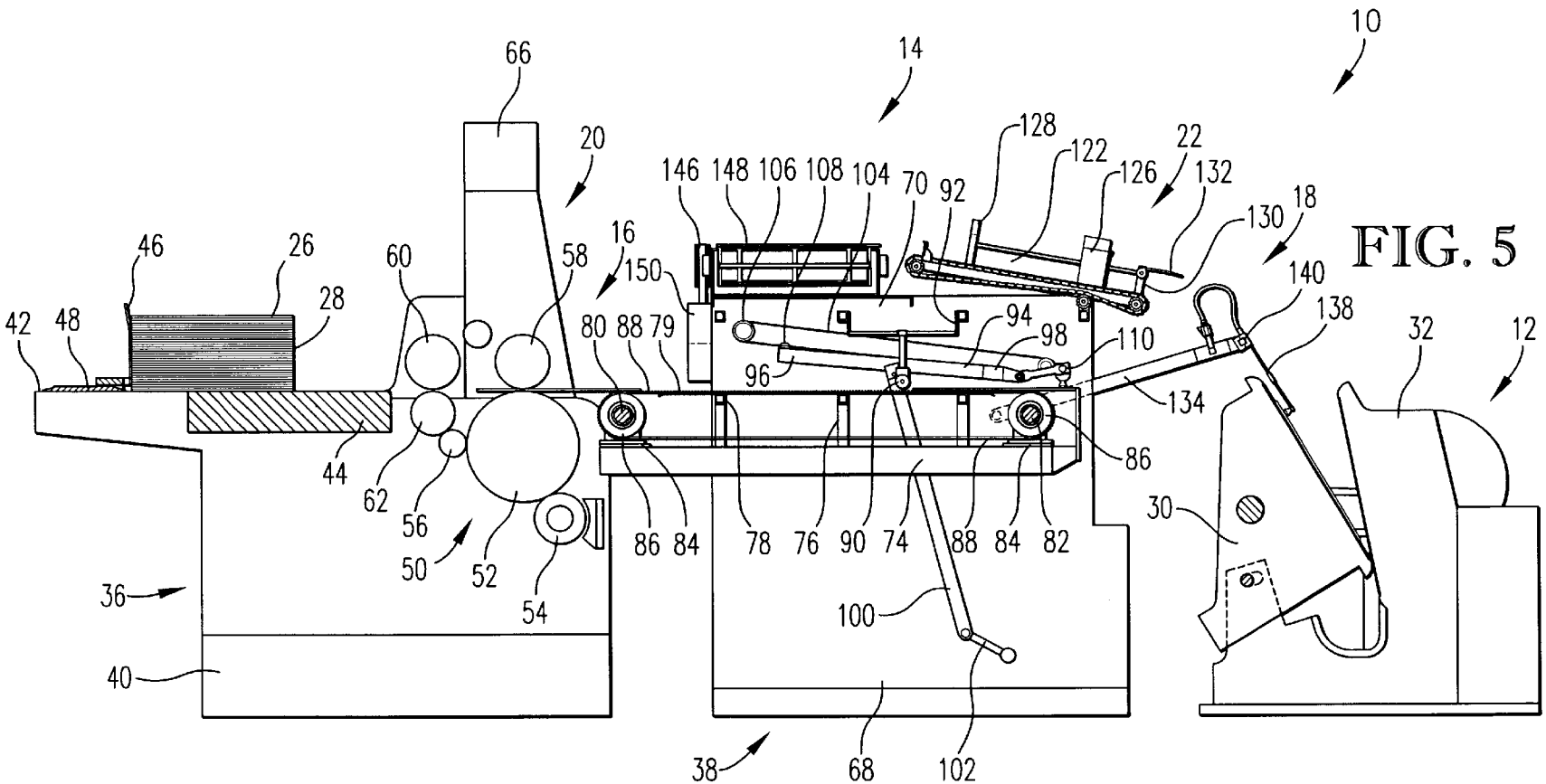
FIG. 5 is a sectional view similar to that of FIG. 4, but showing the clamshell die during opening thereof and with the pickup member operatively engaging a cut blank for removal thereof.
Figure 6:
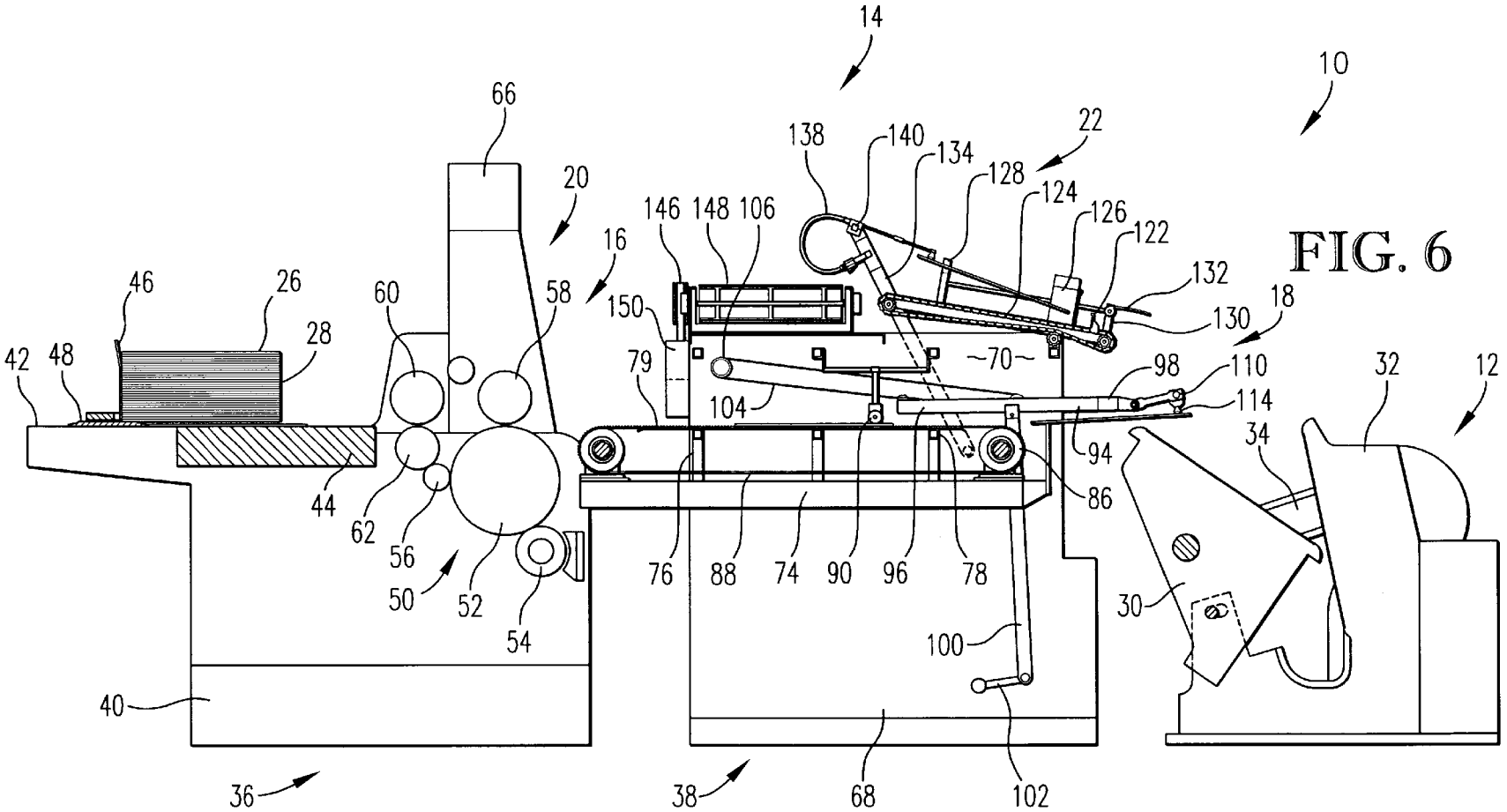
FIG. 6 is a sectional view similar to that of FIG. 5, illustrating the die cutter moving to its full open position, with the pickup member depositing a cut blank onto the slide plate of the sheet removal assembly, and with the pickup member moving a fresh, uncut blank toward the die cutter.

The pusher plate 48 is next operated in order to move the lowermost blank 26 from the stack 28 towards printing assembly 20. As illustrated in FIG. 5, the pusher plate 48 is initially upstream of the retainer 46, but upon movement thereof beneath the retainer 46 as illustrated in FIGS. 2–6, the lowermost blank is moved forwardly across vacuum section 44 and into the nip presented by rollers 60,62. These rollers advance the blank through the nip defined between plate roller 52 and backing roller 58, where the underside of the blank is printed (see FIG. 5). As the printed blank passes from the assembly 20, it encounters the upper runs of the belts 88 and is thus moved toward die cutter 12. The hold down roller 90 ensures that the blank lies flat upon the belts 88. As the blank reaches the end of the belts 88, the pickup member 18 comes into play to engage, lift and deliver the blank into die cutter 12. Specifically, the initial orientation of the pickup member 18 is illustrated in FIG. 5 where the vacuum cups 114 engage and grip the upper surface of the blank; thereupon, the arms 94 are moved by shifting of the belts 104 in a forward direction as illustrated in FIGS. 6 and 1–3 until the blank is positioned over the fully opened platen 30. At this point the vacuum to the cups 114 is relieved, thereby allowing the blank to fall under the influence of gravity onto platen 30. Although not shown in detail, it will be understood that the platen 30 would typically include alignment blocks or similar structure to insure that the blank is properly seated on the platen face.

Next, the arms 94 are withdrawn by a reverse movement of the belts 104 so that member 18 reassumes the FIG. 5 position, and simultaneously the platen 30 is pivoted to the cutting position depicted in FIG. 4, so as to cut the blank in the desired configuration. The platen 30 is then reopened and the cut sheet removal assembly 22 is operated. This involves movement of the support arms 134 in a forward direction from the retracted position of FIG. 1 to the fully extended pickup position of FIG. 5. As the fingers 138 approach the surface of the cut blank within die cutter 12, a vacuum is drawn through tubing 142. This enables the fingers to grip the cut blank in order to lift the blank upwardly and rearwardly to a position above slide plate 116 (see FIG. 6). The vacuum is then relieved, allowing the sheet to drop onto the slide plate 116. Proper placement and alignment of the sheet on the slide plate is assured by virtue of the guides 126, 128 and 132. At this point the pusher bar 122 (which is stationed as shown in FIG. 7 adjacent the forward end of the plate 116) is shifted by movement of the drive assemblies 124 upwardly along the length of the plate 116. This serves to push the blank upwardly past the upper end of the plate 116 and onto belt 148 of conveyer 146. The latter then moves the blank to the stripper 24 for final processing.

It will of course be understood that in normal high speed operations the various components described above will be operating simultaneously, i.e., during retraction of the pickup member 18, the removal assembly 22 and die cutter 12 are also operating. Of course, as explained above, the timing of the components of station 12 can be effected in a number of ways all well within the skill of the art.

We claim:

1. A blank processing station, comprising:

a clam shell die cutter comprising a pair of platens and a drive assembly operable to move at least one of the platens to alternately open and close the platens during die cutting operations;

a feeding device operable to feed individual feedstock sheets into said die cutter when the latter is open, said feeding device comprising a transfer mechanism for individually shifting respective sheets from a stack thereof towards said die cutter, and a pickup member that successively moves each respective sheet from the feeding device and into said die cutter when the latter is open, said transfer mechanism comprising a reciprocal pusher plate operable to engage and shift the bottom most blank from said stack thereof, and a transfer belt presenting a generally horizontal upper run oriented to receive each respective blank and to deliver the same for pickup thereof by the pickup member; and a printing assembly located in the path of said sheets between said pusher plate and said transfer belt, said printing assembly including printing rolls operable to grip each of said sheets received from the pusher plate, to convey said sheets to said transfer belt, and to imprint each of the sheets during passage thereof through the printing assembly.

2. The station of claim 1, said pickup member including a vacuum pickup unit shiftable between a pickup position adjacent said belt and a delivery position for placement of the respective blanks in the die cutter.

3. The station of claim 2, including a drive for said pickup unit comprising a shiftable belt, said pickup unit operably coupled with said belt.

4. The station of claim 1, including a die cut blank removal assembly operable to successively remove individual die cut blanks from said clamshell die cutter upon opening thereof.

5. The station of claim 4, said removal assembly comprising a vacuum pickup member shiftable between a pickup position adjacent the clamshell die cutter when the latter is open, and a delivery position for delivery of an individual cut blank to an outfeed device.

6. The station of claim 5, said outfeed device comprising an outfeed conveyor.

7. The station of claim 5, said removal assembly further including a slide plate for successive receipt of said cut blanks, and a shiftable pusher member adjacent said slide plate for successively pushing said cut blanks along said slide plate and toward said outfeed device.

8. The station of claim 7, including a drive assembly coupled with said pusher member.

9. A blank processing station, comprising:

a clam shell die cutter comprising a pair of platens and a drive assembly operable to move at least one of the platens to alternately open and close the platens during die cutting operations;

a feeding device operable to feed individual feedstock sheets into said die cutter when the latter is open said feeding device comprising a transfer mechanism for individually shifting respective sheets from a stack thereof towards said die cutter, and a pickup member that successively moves each respective sheet from the feeding device and into said die cutter when the latter is open; and a die cut blank removal assembly operable to successively remove individual die cut blanks from said clamshell die cutter upon opening thereof, said removal assembly comprising a vacuum pickup member shiftable between a pickup position adjacent the clamshell die cutter when the latter is open, and a delivery position for delivery of an individual cut blank to an outfeed device, said removal assembly further including a slide plate for successive receipt of said cut blanks, and a shiftable pusher member adjacent said slide plate for successively pushing said cut blanks along said slide plate and toward said outfeed device.

10. The station of claim 9, including a drive assembly coupled with said pusher member.

* * * * *